US009687045B2

(12) United States Patent
Leary et al.

(10) Patent No.: US 9,687,045 B2
(45) Date of Patent: Jun. 27, 2017

(54) ARTICLE OF FOOTWEAR HAVING AN UPPER WITH INFLATION SYSTEM

(71) Applicant: Reebok International Limited, London (GB)

(72) Inventors: Kevin Leary, Dedham, MA (US); Thomas Piacentini, Waltham, MA (US); Paul Davis, Blackstone, MA (US); Paul Bates, Somerset, MA (US); Paul Litchfield, Westboro, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 0 days.

(21) Appl. No.: 14/634,366

(22) Filed: Feb. 27, 2015

(65) Prior Publication Data

US 2016/0249706 A1 Sep. 1, 2016

(51) Int. Cl.
*A43B 23/02* (2006.01)
*A43B 23/22* (2006.01)
*A43B 7/14* (2006.01)

(52) U.S. Cl.
CPC ..... *A43B 23/029* (2013.01); *A43B 7/1495* (2013.01); *A43B 23/022* (2013.01); *A43B 23/027* (2013.01); *A43B 23/0235* (2013.01); *A43B 23/22* (2013.01)

(58) Field of Classification Search
CPC ... A43B 5/0407; A43B 5/0405; A43B 5/0429; A43B 7/085; A43B 7/14; A43B 23/0285; A43B 23/028; A43B 23/029; A43B 23/026; A43B 23/22
USPC ..... 36/93, 45, 29
See application file for complete search history.

(56) References Cited

U.S. PATENT DOCUMENTS 4,995,173 A * 2/1991 Spier ..... A43B 5/0407 36/114
5,074,765 A * 12/1991 Pekar ..... F04B 45/04 36/29
5,113,599 A * 5/1992 Cohen ..... A43B 17/035 36/114
5,158,767 A * 10/1992 Cohen ..... A43B 5/0407 36/114
5,253,435 A * 10/1993 Auger ..... A43B 5/00 36/114
5,257,470 A * 11/1993 Auger ..... A43B 23/029 36/114

(Continued)

*Primary Examiner* — Shaun R Hurley
*Assistant Examiner* — Bao-Thieu L Nguyen
(74) *Attorney, Agent, or Firm* — Sterne, Kessler, Goldstein & Fox P.L.L.C.

(57) ABSTRACT

An article of footwear with a sole and an upper. The upper includes an inner layer configured to receive a foot and an outer layer with a first portion more stretchable than a second portion. A strobel board is disposed above the sole and attached to the inner layer. An inflatable bladder is disposed between the inner layer and the outer layer and attached to both a medial side and a lateral side of the strobel board. The inflatable bladder extends across a throat region of the upper and is operatively coupled with an inflation mechanism and release mechanism configured to inflate and deflate the inflatable bladder. A saddle is disposed between the inflatable bladder and the outer layer in lateral and medial quarter regions of the upper, but not extending into the throat region. The first portion of the outer layer covers the inflatable bladder at the throat region.

30 Claims, 9 Drawing Sheets

(56) References Cited

U.S. PATENT DOCUMENTS 5,343,638 A * 9/1994 Legassie ..... A43B 3/0005 36/28
5,351,710 A * 10/1994 Phillips ..... A43B 13/203 137/223
5,372,487 A * 12/1994 Pekar ..... F04B 33/00 137/512.15
5,416,988 A * 5/1995 Potter ..... A43B 5/00 36/114
5,430,961 A * 7/1995 Faulconer ..... A43B 3/0063 36/71
5,435,230 A 7/1995 Phillips
5,444,926 A * 8/1995 Allen ..... A43B 5/0407 36/29
5,480,287 A * 1/1996 Pozzebon ..... A43B 5/0407 29/516
5,588,227 A * 12/1996 Goldston ..... A43B 1/0018 36/29
5,765,298 A * 6/1998 Potter ..... A43B 5/00 36/114
5,987,779 A * 11/1999 Litchfield ..... A43B 13/203 36/29
6,145,430 A * 11/2000 Able ..... F04B 43/0063 92/100
6,189,172 B1 * 2/2001 Baek ..... A43B 5/0407 12/142 P
6,409,486 B1 * 6/2002 Baek ..... A43B 5/0407 251/321
6,557,274 B2 5/2003 Litchfield et al.
7,254,908 B2 * 8/2007 Ungari ..... A43B 1/0054 36/29
7,395,617 B2 * 7/2008 Christensen ..... B29D 35/122 156/292
7,478,488 B1 * 1/2009 Davis ..... A43B 7/081 36/29
7,546,696 B1 * 6/2009 Acheson ..... A43B 13/203 36/29
7,622,014 B2 11/2009 Millette et al.
7,823,298 B2 * 11/2010 Nishiwaki ..... A43B 5/10 36/50.1
8,540,838 B2 9/2013 Millette et al.
8,572,786 B2 11/2013 Davis et al.
8,578,632 B2 * 11/2013 Bell ..... A43B 1/0072 36/45
8,661,714 B2 * 3/2014 Sussmann ..... A43B 3/24 36/102
8,677,652 B2 * 3/2014 Marvin ..... A43B 13/20 36/45
8,925,129 B2 * 1/2015 Dojan ..... A43B 23/0235 12/142 R
2001/0032399 A1 * 10/2001 Litchfield ..... A43B 1/0072 36/88
2002/0029493 A1 * 3/2002 Baek ..... A43B 5/0407 36/29
2004/0003515 A1 * 1/2004 Marvin ..... A43B 13/20 36/45
2004/0003517 A1 * 1/2004 Marvin ..... A43B 13/20 36/93
2005/0028404 A1 * 2/2005 Marvin ..... A43B 1/0072 36/45
2005/0097779 A1 * 5/2005 Fang ..... A43B 23/029 36/54
2006/0048415 A1 * 3/2006 Marvin ..... A43B 13/20 36/93
2006/0112593 A1 * 6/2006 Marvin ..... A43B 13/20 36/29
2006/0130369 A1 * 6/2006 Christensen ..... A43B 13/20 36/93
2007/0000605 A1 * 1/2007 Millette ..... A43B 13/203 156/308.4
2011/0192052 A1 * 8/2011 Quagliotto ..... A43B 5/0407 36/93
2012/0084999 A1 * 4/2012 Davis ..... A43B 23/029 36/93
2012/0167413 A1 * 7/2012 Marvin ..... A43B 13/20 36/83
2013/0219750 A1 * 8/2013 Dojan ..... A43B 23/0265 36/87
2013/0227857 A1 * 9/2013 Schindler ..... A43B 23/029 36/83
2014/0053968 A1 2/2014 Millette et al.
2014/0059890 A1 3/2014 Davis et al.
2014/0157627 A1 * 6/2014 Smaldone ..... A43B 5/0401 36/83
2014/0202042 A1 * 7/2014 Berend ..... A43B 13/141 36/25 R
2014/0223771 A1 * 8/2014 Berend ..... A43B 23/0235 36/83
2015/0113831 A1 * 4/2015 Weingart ..... A43B 5/18 36/87
2015/0208762 A1 * 7/2015 Reinhardt ..... A43B 23/026 36/45
2015/0257476 A1 * 9/2015 Panian ..... A43B 5/00 36/114
2015/0351488 A1 * 12/2015 Davis ..... A43B 7/14 36/88
2016/0058100 A1 * 3/2016 Dealey ..... A43B 1/04 36/84

* cited by examiner

ARTICLE OF FOOTWEAR HAVING AN UPPER WITH INFLATION SYSTEM

BACKGROUND OF THE INVENTION

Field of the Invention

Embodiments of the present invention relate generally to articles of footwear; and more specifically to an upper with an inflation system, and footwear and methods of manufacturing that include the upper.

Background Art

Individuals are often concerned with the amount of cushioning and the fit an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to cushion the wearer's foot and protect it from these forces. To achieve adequate cushioning, many footwear soles are relatively thick and heavy. When sole size and/or weight are reduced to achieve other performance goals, protection of the wearer's foot is often compromised.

Although the human foot possesses natural cushioning and rebounding characteristics, the foot alone is incapable of effectively overcoming many of the forces encountered during every-day activity. Unless an individual is wearing shoes that fit properly and provide proper cushioning and support, the soreness and fatigue associated with every-day activity is more acute, and its onset accelerated. The discomfort for the wearer that results may diminish the incentive for further activity. Equally important, inadequately cushioned and improperly fit footwear can lead to injuries such as blisters; muscle, tendon and ligament damage; and bone stress fractures improper footwear can also lead to other ailments, including back pain.

Proper footwear should complement the natural functionality of the foot, in part, by incorporating a sole (typically including an outsole, midsole and insole) and/or an upper which absorbs shocks and provides appropriate cushioning. Therefore, a continuing need exists for innovations in providing cushioning to articles of footwear. Furthermore, because the desired fit provided by an article of footwear differs for various individuals and activities, there is a need for innovations related to customized and/or tunable fit in articles of footwear.

BRIEF SUMMARY OF THE INVENTION

In one embodiment, an article of footwear includes an upper comprising an inner layer configured to receive a foot and an outer layer having a first portion more stretchable than a second portion. The article of footwear further includes a sole attached to the upper and a strobel board disposed above the sole and attached to the inner layer. An inflatable bladder is disposed between the inner layer and the outer layer and is attached to both a medial side and a lateral side of the strobel board and extends across a throat region of the upper. An inflation mechanism and a release mechanism are operatively coupled with the inflatable bladder and configured to inflate and deflate the inflatable bladder. Also, a saddle is disposed between the inflatable bladder and the outer layer in lateral and medial quarter regions of the upper and does not extend into the throat region. The first portion of the outer layer covers the inflatable bladder at the throat region.

In some embodiments, the saddle is integral with the strobel board.

In some embodiments, the inner layer is a bootie. In some embodiments, the inner layer is spandex (e.g., LYCRA® material available from Invista).

In some embodiments, the inflatable bladder comprises a release agent cured to a first film by the application of ultraviolet light. In some embodiments, the release agent is silicone fortified. In some embodiments, the release agent is one of a paint, ink, paper, textile, particulate, photosensitive agent, polytetrafluoroethylene (e.g., TEFLON® material available from Chemours), silicone, plastic, and acid.

In some embodiments, the inflatable bladder includes a first film, a release agent applied and cured to the first film in a pattern that corresponds to the shape of an inflatable compartment of the inflatable bladder, and a second film adhered to the first film such that the release agent is disposed between the first film and the second film, and the first film and the second film do not adhere in the vicinity of the release agent thereby forming the inflatable compartment with a peripheral edge.

In some embodiments, the saddle includes a plurality of loops configured to extend through slots in the outer layer and receive a shoelace. In some embodiments, the plurality of loops is a single continuous cord. In some embodiments, the saddle also includes a lace piece over a portion of the continuous cord.

In some embodiments, the outer layer has a screen printing on an outer surface.

In some embodiments, the throat region is tongueless.

In some embodiments, the saddle is configured to limit outward bulging of the inflatable bladder. In some embodiments, the saddle is configured to limit bulging of the inflatable bladder in one of a lateral and a medial direction.

In some embodiments, the inflatable bladder is attached to the outer layer in the throat region. In some embodiments, the inflatable bladder is attached to the outer layer and the inner layer in the throat region.

In one embodiment, an upper for an athletic shoe includes an inner layer configured to attach to an insole of the athletic shoe and receive a foot, an outer layer having a first portion more stretchable than a second portion, an inflatable bladder disposed between the inner layer and the outer layer and extending from a lower lateral side of the upper across a throat region of the upper to a lower medial side of the upper, an inflation mechanism and a release mechanism operatively coupled with the inflatable bladder and configured to inflate and deflate the inflatable bladder, a lateral saddle disposed between the inflatable bladder and the outer layer in a lateral quarter region of the upper and not extending into the throat region, and a medial saddle disposed between the inflatable bladder and the outer layer in a medial quarter region of the upper and not extending into the throat region. The throat region of the upper is tongueless and aligns with an edge of each of the lateral and medial saddles. The first portion of the outer layer is disposed in the throat region.

In some embodiments, the inner layer is a bootie. In some embodiments, the inner layer is spandex (e.g., LYCRA® material available from Invista).

In some embodiments, the inflatable bladder includes a release agent cured to a first film by the application of ultraviolet light. In some embodiments, the release agent is silicone fortified. In some embodiments, the release agent is one of a paint, ink, paper, textile, particulate, photosensitive agent, polytetrafluoroethylene (e.g., TEFLON® material available from Chemours), silicone, plastic, and acid.

In some embodiments, the inflatable bladder includes, a first film, a release agent applied and cured to the first film in a pattern that corresponds to the shape of an inflatable compartment of the inflatable bladder, and a second film adhered to the first film such that the release agent is disposed between the first film and the second film, and the first film and the second film do not adhere in the vicinity of the release agent thereby forming the inflatable compartment with a peripheral edge.

In some embodiments, each of the lateral and medial saddles includes a plurality of loops configured to extend through slots in the outer layer and receive a shoelace. In some embodiments, each of the plurality of loops on the lateral saddle and the plurality of loops on the medial saddle is a single continuous cord. In some embodiments, each of the lateral and medial saddles also includes a lace piece over a portion of the continuous cord.

In some embodiments, the outer layer includes a screen printing on an outer surface.

In some embodiments, each of the lateral and medial saddles is configured to limit outward bulging of the inflatable bladder. In some embodiments, each of the lateral and medial saddles is configured to limit bulging of the inflatable bladder in one of a lateral and a medial direction.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
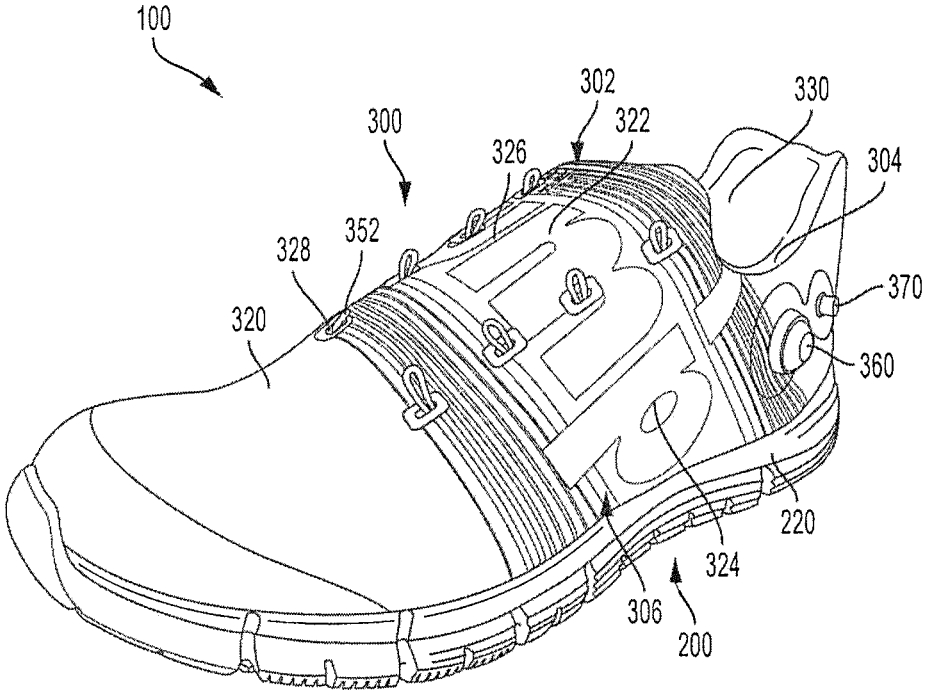
FIG. 1 is a lateral perspective view of an article of footwear according to one embodiment.
Figure 2:
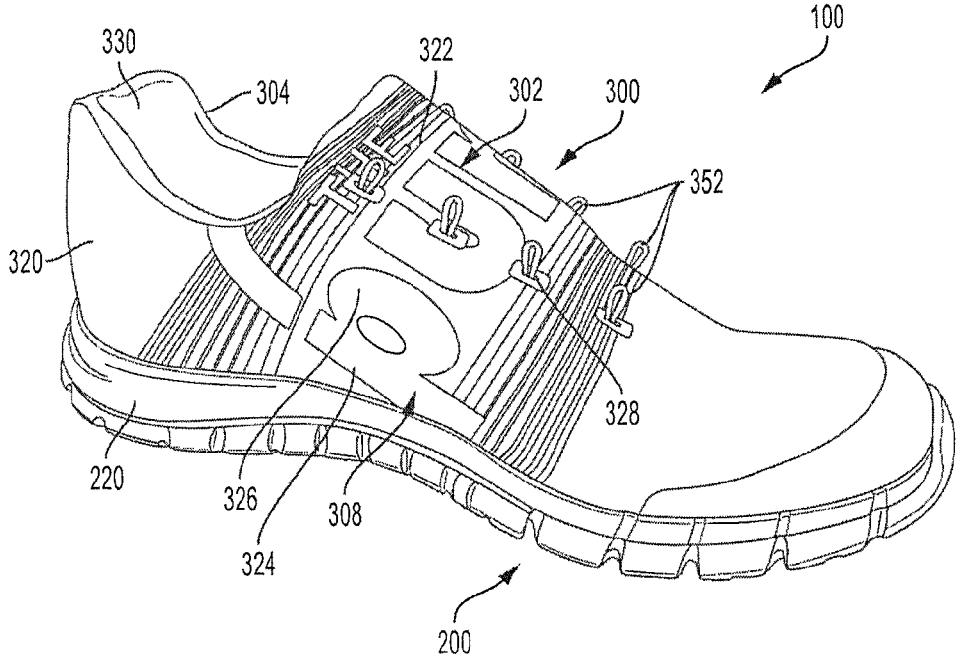
FIG. 2 is a medial perspective view of an article of footwear according to one embodiment.
Figure 3:
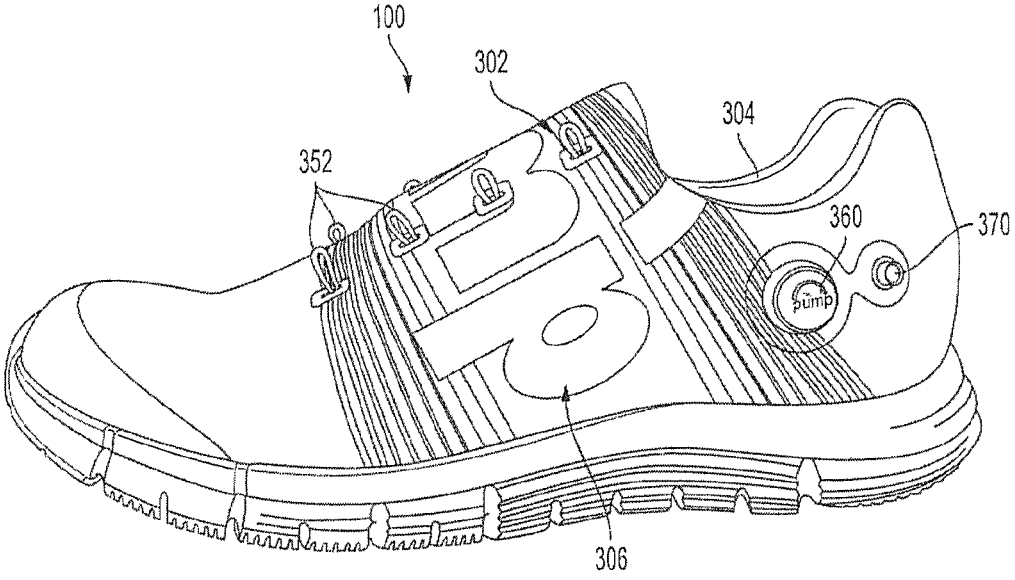
FIG. 3 is a lateral side view of an article of footwear according to one embodiment.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide cushioning and support for a wearer's foot to achieve the proper and desired tit. In particular, embodiments of the present invention provide an article of footwear with customized or tunable cushioning, support, and fit. The cushioning and fit in embodiments of the article of footwear are tunable by the wearer to achieve the amount of support desired by the wearer. Thus, embodiments of the present invention may help increase the comfort of the wearer's foot and/or may help reduce the risk of various injuries to the foot.

For example, according to some embodiments, the article of footwear includes an upper with an inflation system. The inflation system comprises an inflatable bladder disposed between an outer layer and an inner layer of the upper. An inflation mechanism and a release mechanism allow the wearer to inflate and deflate the inflatable bladder and thus adjust the cushioning, support, and fit provided by the article of footwear according to personal preference or need for the various activities engaged in by the wearer. The article of footwear further provides a saddle member on both lateral and medial sides between the outer layer and the inflatable bladder. The outer layer, inner layer, and saddle members contain and direct the inflatable bladder for optimal cushioning, support, and fit.

Athletic shoe 100, as illustrated, for example, in FIGS. 1-5, is an embodiment of the article of footwear. Athletic shoe 100 may comprise a running shoe, a training shoe, a basketball shoe, and any other suitable athletic shoe. Although athletic shoe 100 is primarily described, other embodiments envision the present invention utilized in other types of footwear, including, but not limited to, non-athletic footwear, and sandals. Moreover, although FIGS. 1-5 depict a shoe for use on the left foot of a wearer, the principles of the present invention are equally applicable to shoes intended for use on the right foot. Athletic shoe 100 comprises both a sole 200 and an upper 300.

Sole 200 suitable for athletic shoe 100 may have various characteristics, as described below. In some embodiments, sole 200 includes one or more of an outsole, a midsole 220, and an insole. According to some embodiments, for example, sole 200 includes all three of an outsole, midsole 220, and an insole. Some embodiments, as illustrated, for example, in FIG. 5, further provide a strobel board 240 having a medial side 242 and a lateral side 244. Strobel board 240, according to some embodiments, is part of the insole. In other embodiments, strobel board 240 is disposed above sole 200. In some embodiments, a sock liner 250 is disposed above the insole or strobel board 240. Athletic shoe 100 may be board lasted or slip lasted. Athletic shoe 100 may include an S slip or a California slip.

Sole 200 may be constructed of any materials common in various applications of shoes. The materials used for the outsole, midsole 220, and the insole may be different from each other or the same. In some embodiments, for example, the outsole is preferably made with a material that is abrasion resistant, such as rubber. In one embodiment, midsole 770 is made with a foam material, such as ethyl vinyl acetate (EVA) foam or foamed polyurethane. Midsole 220, according to some embodiments, contains a series of flex grooves extending from a medial side to a lateral side to facilitate flexing of athletic shoe 100 during activities, such as running or walking. In some embodiments, the outsole has corresponding flex grooves to further facilitate flexing of athletic shoe 100. Strobel board 240 and sock liner 250 are also preferably made with a foam material. Sock liner 250, according to some embodiments, conforms to the bottom of the wearer's foot. In some embodiments, sock liner 250 provides extra cushioning for the wearer's foot. Sock liner 250 may also be made of a non-woven material or paper.

Although exemplary embodiments have been described above, sole 200 may be any sole suitable for athletic shoe 100. Furthermore, other soles may be appropriate within the scope of the present invention for other types of shoes.

Athletic shoe 100 is further provided with an inflation system. The inflation system includes an inflatable bladder 340 operatively coupled to an inflation mechanism 360 and a release mechanism 370.

Figure 4:
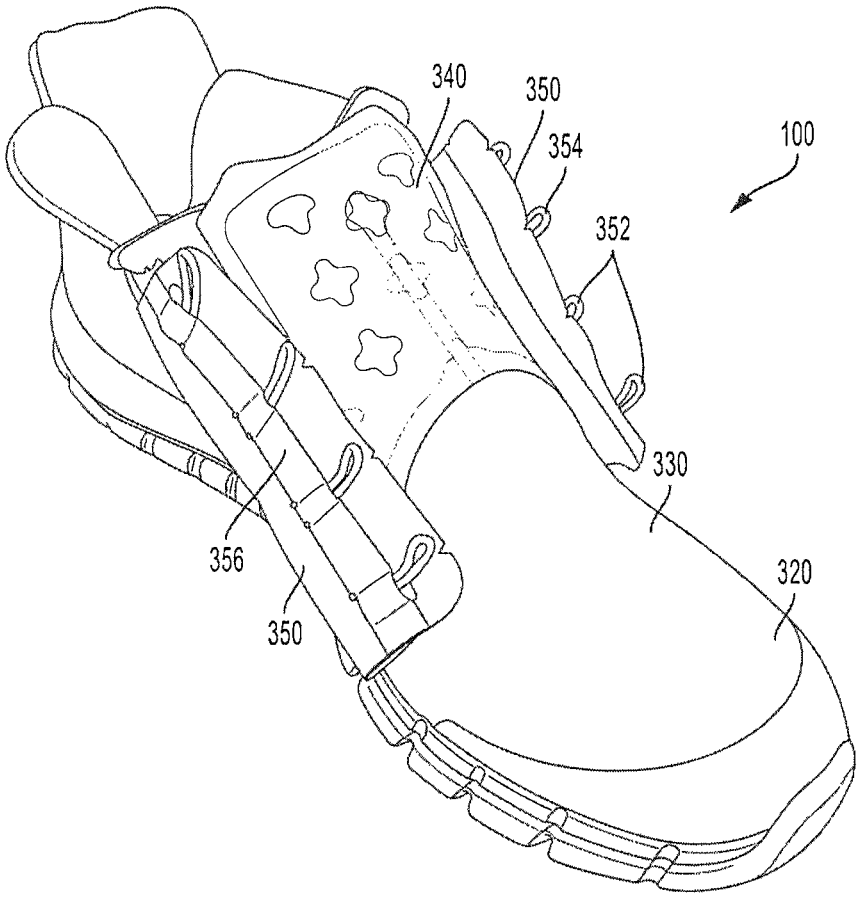
FIG. 4 is a medial perspective exposed view of an article of footwear according to one embodiment.
Figure 5:
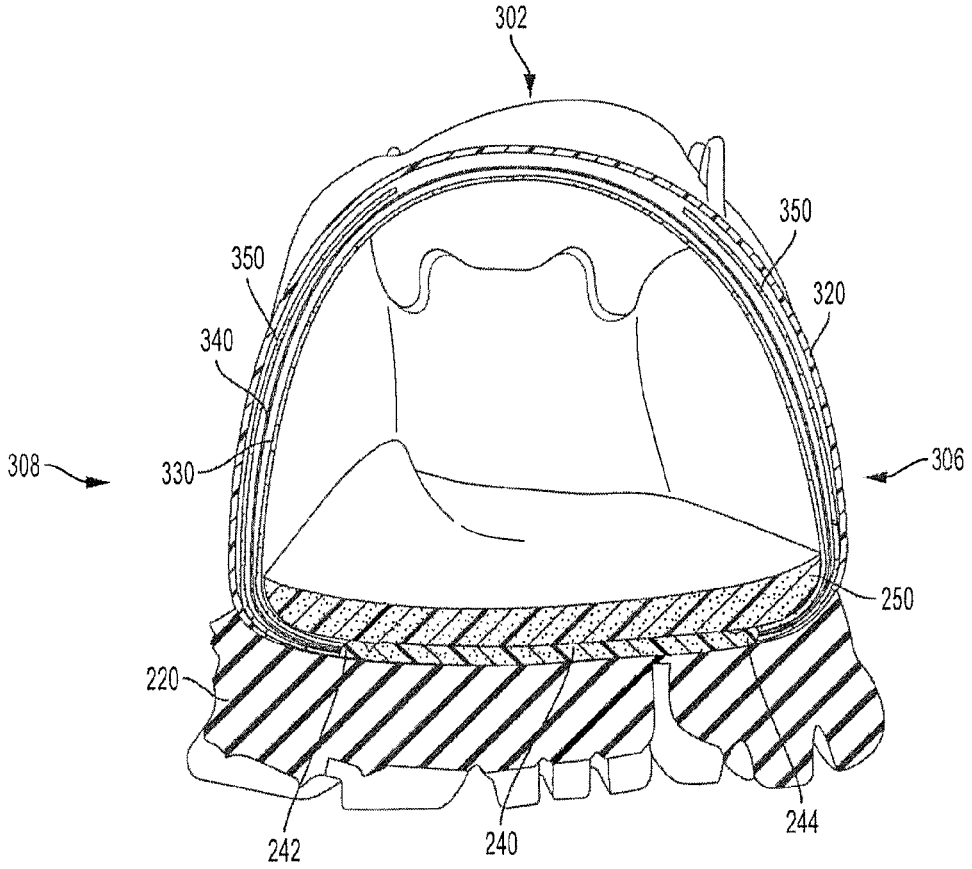
FIG. 5 is a front cross-sectional view of an article of footwear according to one embodiment.

According to some embodiments, athletic shoe 100 comprises inflatable bladder 340. In some embodiments, inflatable bladder 340 is disposed within upper 300, as in FIG. 4, underneath an outer layer 320. FIG. 4 depicts an exposed view of an embodiment of athletic shoe 100 with outer layer 320 removed. Inflatable bladder 340 is at least partially disposed in a throat region 302 of upper 300. In other embodiments, inflatable bladder 340 is at least partially disposed in a lateral quarter region 306. Other embodiments provide inflatable bladder 340 at least partially disposed in a medial quarter region 308. Some embodiments provide inflatable bladder 340 extending from lateral quarter region 306 through throat region 302 to medial quarter region 308. Inflatable bladder 340, according to some embodiments, also extends around a collar 304 of athletic shoe 100.

Inflatable bladder 340 advantageously secures the user's foot in athletic shoe 100 and reduces heel slip. In addition, utilizing inflatable bladder 340 in athletic shoe 100 reduces the need for additional foam or other padding and pieces, thus providing an easier construction and manufacture of athletic shoe 100 compared to standard padded footwear. Athletic shoe 100 with inflatable bladder 340 provides a repeatedly adjustable and customizable fit.

According to some embodiments, inflatable bladder 340 is secured to strobel board 240. In some embodiments, inflatable bladder 340 is secured to strobel board 240 on both medial side 242 and lateral side 244. In some embodiments, inflatable bladder 340 is secured to outer layer 320 in throat region 302 of athletic shoe 100. In some embodiments, inflatable bladder 340 is secured to an inner layer 330 in throat region 302 of athletic shoe 100. In some embodiments, inflatable bladder 340 is secured to both outer layer 320 and inner layer 330 in throat region 302 of athletic shoe 100.

Inflatable bladder 340 may be secured to outer layer 320, inner layer 330, strobel board 240, or other parts of athletic shoe 100 by stitching, adhesive, bonding, or other suitable fastening means. For example, in some embodiments, inflatable bladder is secured to outer layer 320 and inner layer 330 in throat region 302 by stitching. In some embodiments, inflatable bladder 340 is secured to strobel board 240 by stitching to both medial side 242 and lateral side 244. In some embodiments inflatable bladder 340 is also secured to inner layer 330 at a region near strobel board 240 by an adhesive. Other configurations of securing inflatable bladder 340 to other portions of upper 300 are also envisioned. For example, inflatable bladder 340 could be attached via radio frequency (hereafter referred to as "RF") welding, sonic welding, heat sealing, or other mechanical means.

Inflatable bladder 340 is not limited to the locations described above and may also be disposed in other portions of upper 300 or in sole 200. Inflatable bladder 340, for example, may be disposed in portions of sock liner 250 or portions of the insole. Moreover, while inflatable bladder 340 is primarily discussed as a single bladder, embodiments include multiple inflatable bladders within athletic shoe 100. In some embodiments, inflatable bladder 340 is hidden from view when athletic shoe 100 is worn (as in FIG. 1), while in other embodiments, inflatable bladder 340 is at least partially visible when athletic shoe 100 is worn (not shown).

Figure 6:
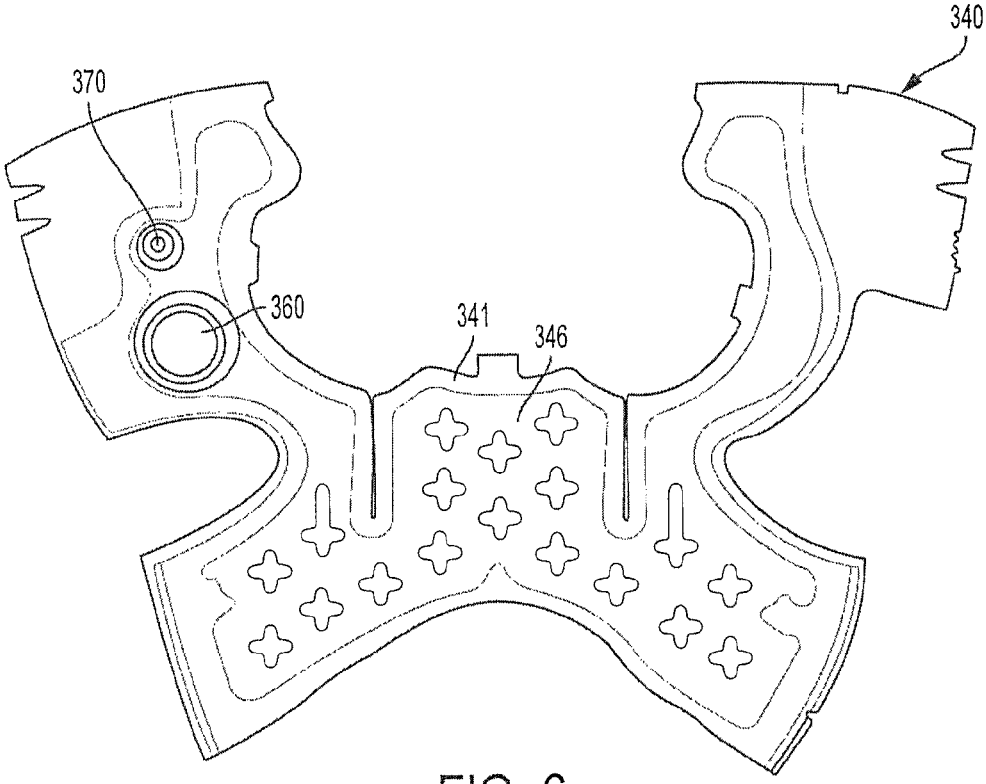
FIG. 6 is a top plan view of an inflatable bladder configured for an article of footwear according to one embodiment.
Figure 7:
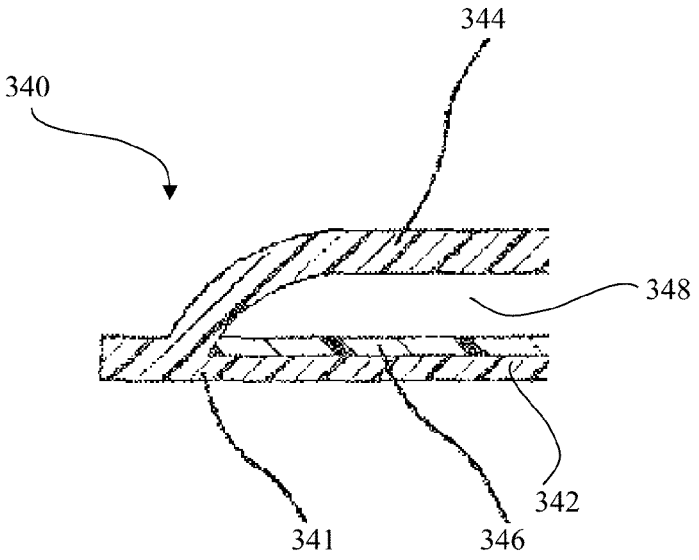
FIG. 7 is a cross-sectional view of a portion of an inflatable bladder configured for an article of footwear according to one embodiment.

Any suitable type or shape of bladder suitable for footwear may be utilized within the scope of the present invention as inflatable bladder 340. One embodiment of inflatable bladder 340 is illustrated in FIGS. 6-7. In some embodiments, inflatable bladder 340 is a printed bladder as is described in commonly owned U.S. Pat. No. 8,572,786, entitled "Method for Manufacturing Inflatable Bladders for Use in Footwear and Other Articles of Manufacture," the disclosure of which is incorporated herein by reference thereto.

For example, according to some embodiments, inflatable bladder 340, as illustrated in FIGS. 6-7, has a first film 342 and a second film 344. Disposed between first film 342 and second film 344 is a release agent 346. Release agent 346 may be disposed in a pattern that will correspond to a pattern of an inflatable compartment 348 formed by the following method.

According to some embodiments, release agent 346 is disposed on first film 342. Alternatively, release agent 346 may be disposed on both first film 342 and second film 344, as, for example, in FIG. 12. First film 342 and second film 344 may be identical or different materials; but they must be each made from a material that may be adhered together to form a fluid-tight seal. Films can be formed from a variety of polymers such as thermoplastic resins, other elastomeric materials, thermoset materials, and composites thereof, including but not limited to, thermoplastic polyurethane (TPU), ethylenevinylacetate/polyethylene copolymer, polyester elastomer (e.g. HYTREL® material available from DuPont), polyethylene, polypropylene, neoprene, natural rubber, dacron/polyester, polyvinylchloride, thermoplastic rubbers, nitrile rubber, butyl rubber, sulfide rubber, methyl rubber, silicone rubber, polyvinyl acetate, Buna-N, Buna-S, polystyrene, ethylene propylene, polybutadiene, chlorfulfonated polythylene, nylon, partially set thermoset materials, ethylene vinyl acetate (EVA) foam, thermoset rubber, prepreg, and others.

Release agent 346 can be formed from a variety of materials, such as paint, ink, paper, textile, particulate, photosensitive agent, polytetrafluoroethylene (e.g., TEFLON® material available from Chemours), silicone, plastic, acid, or any other material suitable for preventing first film 342 and second film 344 from adhering to each other where the release agent 346 has been disposed. In some embodiments, release agent 346 is cured to first film 342. For example, release agent 346 may be cured to first film 342 by the application of ultraviolet light. In some embodiments, release agent 346 may be silicone fortified.

After release agent 346 is applied to, disposed on, and/or cured to first film 342, first film 342 and second film 344 are bonded together by the application of heat and/or pressure. However, where release agent 346 is disposed between first film 342 and second film 344, there exists an inflatable compartment 348 with a peripheral edge 341. In some embodiments, this method may be used to create multiple inflatable compartments 348. The size, shape, and pattern of inflatable compartment 348 may vary from shoe to shoe to accommodate various needs and preferences.

In other embodiments, alternative methods of creating inflatable bladder 340 may be used.

Inflatable bladder 340 is operatively coupled to inflation mechanism 360. Inflation mechanism 360 may be located anywhere on athletic shoe 100. In some embodiments, inflation mechanism 360 is located on a lateral side of athletic shoe 100. Some embodiments provide inflation mechanism 360 below collar 304 on the lateral side. Inflation mechanism 360 may take many suitable forms. For example, according to some embodiments, inflation mechanism 360 is an on-board pump. While in some embodiments inflation mechanism 360 is operated with a wearer's own hand or fingers, other embodiments require an external mechanism to operate inflation mechanism 360. Yet other embodiments provide inflation mechanism 360 that may be operated by either the wearer's hand or an external device.

In some embodiments, inflation mechanism 360 is an inflation mechanism as disclosed in commonly owned U.S. Pat. No. 5,435,230, entitled "Inflation Mechanism," the disclosure of which is incorporated herein by reference thereto.

Figure 8:
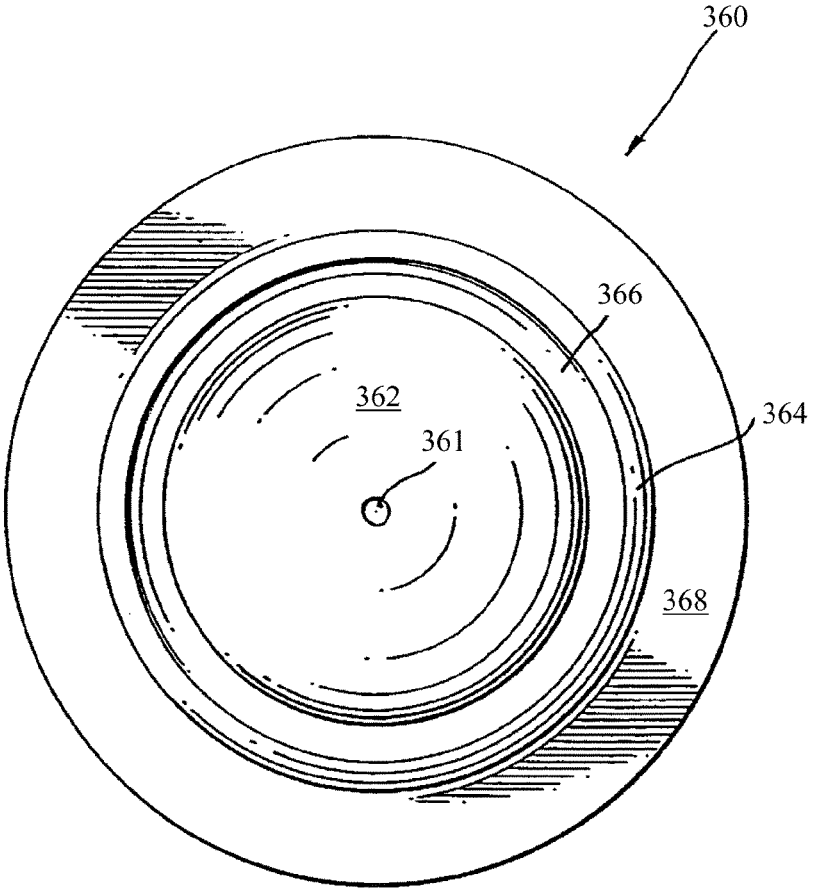
FIG. 8 is a plan view of an inflation mechanism for an article of footwear according to one embodiment.
Figure 9:
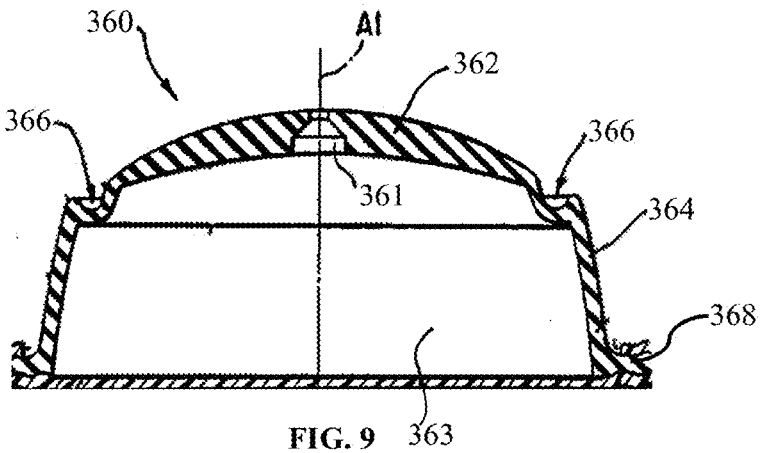
FIG. 9 is a cross-sectional view of an inflation mechanism for an article of footwear according to one embodiment.
Figure 10:
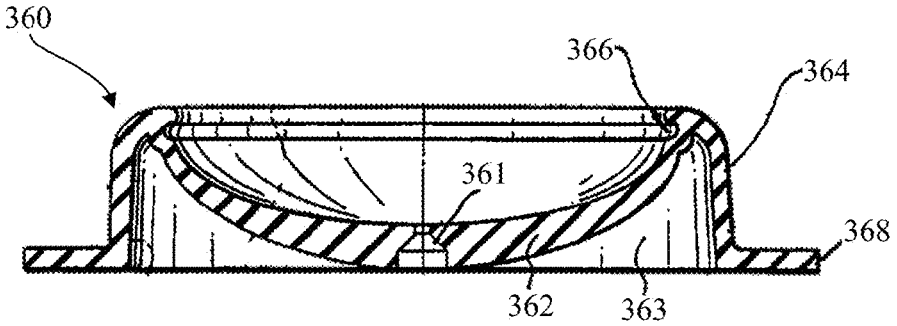
FIG. 10 is a cross-sectional view of an inflation mechanism for an article of footwear according to one embodiment upon the application of a force.

An embodiment of inflation mechanism 360 is shown in FIGS. 8-10. Inflation mechanism 360 is piston-like, such that upon the application of a force directed substantially along its central axis A1, air is forced into inflatable bladder 340.

Inflation mechanism 360 generally comprises four elements: an inflation head 362, a sidewall 364, flexure means 366, and an outer lip 368. These elements define an interior chamber 363. Each of these elements will now be described in greater detail.

Inflation head 362 is circular in plan. As best seen in FIG. 9, inflation head 362 is generally crescent-shaped in cross section tapering from a greatest thickness proximate axis A1 to a minimum thickness proximate the area where inflation head 362 joins flexure means 366. The ratio of the radius of curvature of an outer surface to an inner surface of inflation head 362 is approximately 0.60. Inflation head 362 defines a hole 361 which extends through inflation head 362 in substantial alignment with central axis A1. Hole 361 increases in diameter from the outer surface to the inner surface of inflation head 362. Hole 361 controls access of air (or other fluid) to interior chamber 363 of inflation mechanism 360. When inflation head 362 is depressed (as shown in FIG. 10), that which depresses inflation head 362 covers hole 361 preventing the escape of air from within interior chamber 363 other than into an associated inflatable bladder 340. When that which depresses inflation head 362 is removed, air is allowed to freely enter hole 361. Thus, hole 361 acts as a one-way valve when closed during compression.

Sidewall 364 is generally cylindrical in horizontal cross-section, with sidewall surfaces that are angled from outer lip 368 toward inflation head 362 such that the ratio of curvature of the outer surface of sidewall 364 to an inner surface of sidewall 364 is approximately 1.01. Sidewall 364 terminates along its outer surface at flexure means 366. Although inflation mechanism 360 is shown as having a single cylindrical sidewall 364, it is to be understood that other shapes and a greater number of sidewalk may also be used.

Outer lip 368 is circular in plan and joins sidewall 364 at a bottom area. Outer lip 368 allows inflation mechanism 360 to be attached to inflatable bladder 340 by suitable attachment techniques, such as RF welding or adhesive.

Flexure means 366 is a weakened area of inflation mechanism 360 extending between sidewall 364 and inflation head 362 along the entire periphery of sidewall 364. More specifically, flexure means 366 is a concave groove or living hinge which extends on the exterior of inflation mechanism 360 from an outer perimeter area of inflation head 362 to the outer surface of sidewall 364. Flexure means 366 acts as a hinge, which upon the application of downward force along central axis A1, allows inflation head 362 to fully invert within interior chamber 363 while sidewall 364 remains erect.

FIG. 10 depicts inflation mechanism 360 in a completely depressed state. When force is applied downward along central axis A1, sidewall 364 remains erect, but expands outwardly due to flexure means 366 which permits the complete inversion of inflation head 362 within interior chamber 363. When hole 361 is closed, air is displaced from interior chamber 363. Inflation head 362 moves within sidewall 364 much the same way as a piston moves within a cylinder. This specific geometry enables nearly the entire volume of air within chamber 363 to be compressed when inflation head 362 is in a depressed state. This provides a high compression ratio to be established. That is, the volume within chamber 363 is minimized when inflation head 362 is fully depressed. Therefore the pressure within chamber 363 is maximized when inflation head 362 is fully depressed. The maximum pressure within chamber 363 defines the maximum pressure of that which is being inflated. Thus, the present invention minimizes the volume in chamber 363 when inflation head 362 is fully depressed. In addition, a maximum amount of fluid is displaced from chamber 363. Thus a greater amount of air or fluid is displaced with a lesser number of compressions.

Inflation mechanism 360 is preferably molded of ESTANE™, a thermoplastic urethane (TPU) Which is available from B. F. Goodrich Company, Inc., although other suitable materials may also be used. One such material is PELLETHANE™ #81880, a TPU available from Dow Chemical Corporation ESTANE™ and PELLETHANE™ are elastomeric, resilient, and lightweight, chemically resistant, mold and bond well, and take well to pigmentation, ESTANE™ #58863 has a nominal durometer of approximately 80-85 on the Shore A scale. Inflation mechanism 360 is preferably formed from a monolithic piece of material defining interior chamber 363. In some embodiments, interior chamber 363 may be filled with a foam to assist inflation head 362 in returning to its original configuration following depression. One example is a reticulated, open cell polyurethane foam which has approximately ten to fifty pores per square inch.

Inflation mechanism 360 may be incorporated into inflatable bladder 340. For example, in some embodiments, inflation mechanism 360 may be easily attached (by RF welding or adhesive, for example) to either first film 342 or second film 344 of inflatable bladder 340. Thereby, inflation mechanism 360 is operatively coupled to inflatable bladder 340. In use, the user places a finger or other device over hole 361 and alternately depresses and releases inflation head 362. During depression of inflation mechanism 360, air (or other fluid) is expelled from chamber 363 and flows into inflatable bladder 340. During the release of inflation mechanism 360, hole 361 is uncovered, allowing ambient air (or other fluid) to be drawn through hole 361 to fill chamber 363. This alternate depression and release continues for a sufficient number of times until the bladder or other chamber is inflated to a desired fluid pressure.

Figure 11:
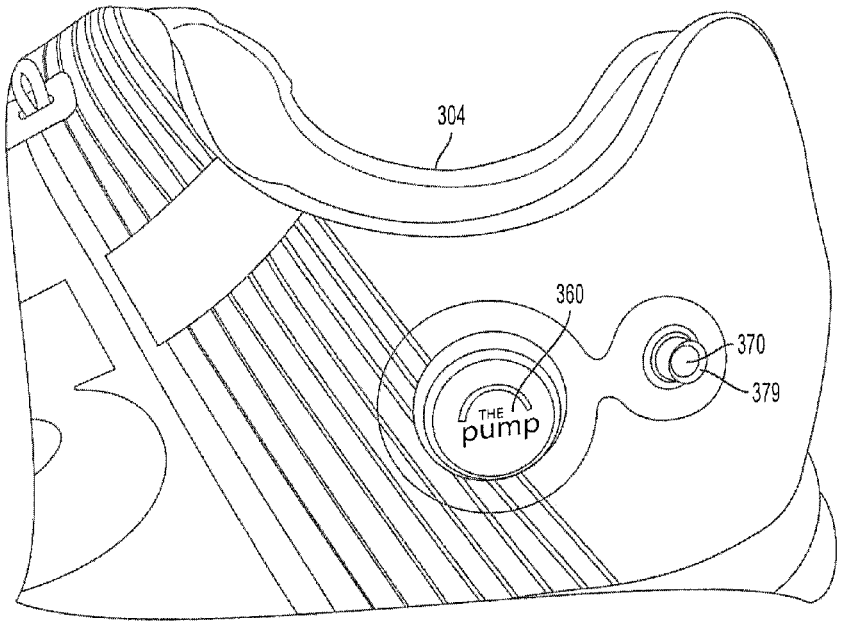
FIG. 11 is a close-up view of an inflation mechanism and release mechanism for an article of footwear according to one embodiment.

Release mechanism 370 is also operatively coupled to inflatable bladder 340 and permits the wearer to release air that has been inflated into inflatable bladder 340. In some embodiments, release mechanism 370 is provided near inflation mechanism 360, as in FIG. 11. Release mechanism 370 is fitted within an aperture of inflatable bladder 340 to enable venting or deflation of the chamber. While release mechanism 370 may be located anywhere on inflatable bladder 340, it is preferable that release mechanism 370 be located where it can be conveniently activated by the wearer. In some embodiments, release mechanism 370 is located on the lateral side of athletic shoe 100 below collar 304.

Figure 12:
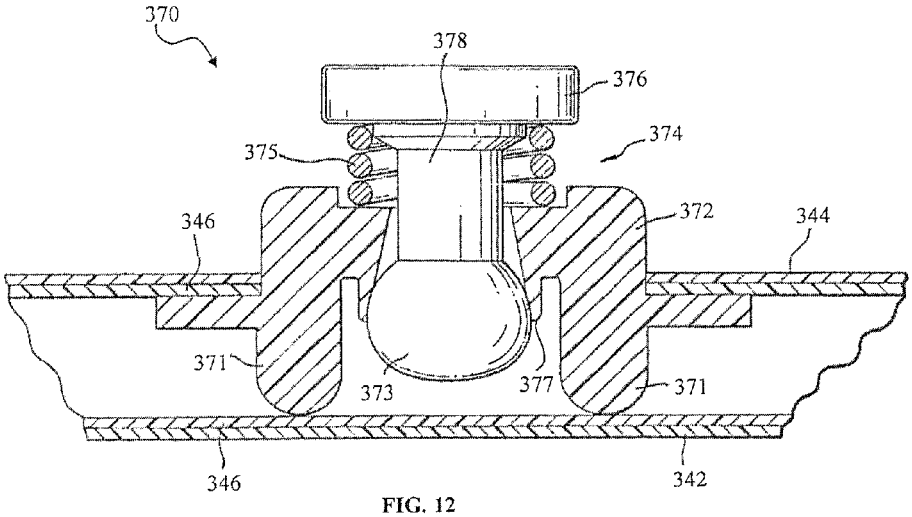
FIG. 12 is a cross-sectional view of a release mechanism for an article of footwear according to one embodiment.

According to some embodiments, as shown, for example, in FIG. 12, release mechanism 370 generally includes a housing 372 and a fitting 374 for controlling the flow of fluid through the release mechanism. Housing 372 is preferably a molded thermal-polyurethane which may be easily attached (by RF welding, for example) to either first film 342 or second film 344 of inflatable bladder 340. At the bottom of housing 372, a plurality of extensions 371 are provided to prevent the opposing film (first film 342 or second film 344) of inflatable bladder 340 from interfering with operation of release mechanism 370.

Fitting 374 comprises a plunger 376 having a stem portion 378 and a stop member 373. A coil spring 375 is disposed about stem portion 378 of plunger 376 to bias fitting 374 in the shown closed position. As illustrated in FIG. 12, when plunger 376 is in the closed position, stop member 373 of plunger 376 abuts against an annular shoulder 377 of housing 372 to prevent leakage of air from inflatable bladder 340. Fitting 374, in some embodiments, also houses a shoulder 379 that keeps plunger 376 from being prematurely activated. According to some embodiments, release mechanism 370 is a one-way film valve system that keeps air in the bladder.

Fitting 374 of release mechanism 370 may be made out of a number of materials including plastics, lightweight metals (such as aluminum) or any other material capable of being molded to a particular specification. Although one exemplary release mechanism 370 has been described, other suitable release mechanisms also exist and may be used in athletic shoe 100 within the scope of the present invention.

According to some embodiments, inflatable bladder 340 is disposed between outer layer 320 and inner layer 330. In some embodiments, inner layer 330 comprises a flexible layer that receives a wearer's foot. According to some embodiments, inner layer 330 completely surrounds the wearer's foot. For example, in one embodiment inner layer 330 may be a bootie. In other embodiments, inner layer 330 covers a top portion and/or side portions of the wearer's foot and is secured to strobel board 240 disposed underneath the wearer's foot. Inner layer 330 may be secured to strobel board 240 by stitching, an adhesive, or other suitable fastening means. Moreover, in some embodiments, both inner layer 330 and outer layer 320 are secured to strobel board 240.

Inner layer 330 may be made from a flexible material. In some embodiments, inner layer 330 is made from a stretchable textile with multi-dimensional stretch. In some embodiments, inner layer 330 is made from spandex (e.g., LYCRA® material available from Invista). According to some embodiments, inner layer 330 provides an insulating layer between the wearer's foot and inflatable bladder 340. This may help contribute to the wearer's comfort while using athletic shoe 100.

Saddle 350 is also disposed between outer layer 320 and inner layer 330. Preferably, saddle 350 is disposed between outer layer 320 and inflatable bladder 340. In some embodiments, saddle 350 is made of a substantially non-stretchable material. Saddle 350 is preferably made of a textile, and more preferably a non-stretchable textile. Saddle 350 may be made of any woven or non-woven material. In some embodiments, saddle 350 is made of nylon.

According to some embodiments, saddle 350 is configured to limit bulging of inflatable bladder 340 in certain directions while simultaneously providing support to the wearer. Saddle 350 may, for example, limit outward bulging of inflatable bladder 340. For example, in some embodiments, saddle 350 limits bulging in one or both of the lateral and medial directions.

Accordingly, in some embodiments, saddle 350 comprises two saddle members on both a lateral and medial side. Saddle 350 may extend from sole 200 over lateral quarter region 306 or medial quarter region 308 up to a border of throat region 302. In some embodiments, saddle 350 may be secured to strobel board 240 by stitching, an adhesive, or other suitable fastening means. In some embodiments, saddle 350 is integral with strobel board 240.

Saddle 350, in some embodiments, includes a plurality of loops 352, near or at throat region 302 of athletic shoe 100. Plurality of loops 352 is configured to extend through slots 328 in outer layer 320 and receive shoelaces. Thus, in some embodiments, the amount that saddle 350 limits outward bulging will at least partially depend on how tightly the wearer ties the shoelaces. In one embodiment, the size of loops 352, may be adjustable. This may, in turn, provide an additional method for limiting the expansion of inflatable bladder 340.

In some embodiments, plurality of loops 352 is configured from a single continuous cord 354. For example, as shown in FIG. 4, cord 354 is a single continuous cord that winds back and forth extending in and out from within saddle 350, thus creating plurality of loops 352. According to some embodiments, a lace piece 356 is disposed on saddle 350, covering at least a portion of cord 354. Lace piece 356, in some embodiments, comprises a webbing. In some embodiments, lace piece 356 provides increased strength to saddle 350 and the eyestay assembly.

In other embodiments, plurality of loops 352 is configured from multiple cords. In one embodiment, plurality of loops 352 is integrally formed with saddle 350. In one embodiment, plurality of loops 352 and saddle 350 may be formed from a single piece of material.

In yet other embodiments, eyelet and lacing systems are used. Eyelets may be individual loops or cords. In other embodiments, eyelets may be a single, continuous cord. Eyelets may also be loops that extend from midsole 220 up along the sides of athletic shoe 100.

Outer layer 320 is the outermost layer of upper 300. In some embodiments, outer layer 320 is a stretchable material. Outer layer 320, in some embodiments, has a first portion 322 that is more stretchable than a second portion 324. In other embodiments, outer layer 320 is uniformly stretchable. Some embodiments provide outer layer 320 that is more stretchable in some directions than in other directions.

According to some embodiments, first portion 322 is disposed in throat region 302 of upper 300. In some embodiments, first portion 322 corresponds to inflatable bladder 340. More specifically, in some embodiments, first portion 322 corresponds to inflatable bladder 340 in throat region 302 and second portion 324 corresponds to inflatable bladder 340 in lateral quarter region 306 and medial quarter region 308. With such a construction, second portion 324 also corresponds to saddle 350 and contributes to limiting bulging of inflatable bladder 340 in a lateral and medial direction. Other configurations of outer layer 320 are envisioned in other embodiments.

Outer layer 320 is secured to inner layer 330 around collar 304 of athletic shoe 100. In some embodiments, outer layer 320 is secured to inner layer 330 by stitching. According to some embodiments, outer layer 320 is secured to midsole 220 around a perimeter of athletic shoe 100. In some embodiments, outer layer 320 is secured to midsole 220 by adhesive.

Outer layer 320, in some embodiments, is also secured to strobel board 240. Outer layer 320 may be secured to strobel board 240 at medial side 242 and lateral side 244 of strobel board 240. Thus, as described above, outer layer 320, inner layer 330, saddle 350, and inflatable bladder 340 may all be secured to strobel board. In some embodiments, this is done by stitching.

Outer layer 320 may include a screen printing 326 or other decorative treatment on its outer surface. Screen printing 326 may contain words, pictures, symbols, icons, or logos. Screen printing 326 may contain various colors or may be a single color. In some embodiments, screen printing 326 covers the entire outer layer 320. In other embodiments, screen printing 326 only covers a portion of the outer layer 320.

Various embodiments described herein afford the wearer with the capability to tune the cushioning and fit of athletic shoe 100 to provide the support desired for the wearer's foot. The proper cushioning and fit may vary from activity to activity. For example, a wearer may desire more or less cushioning while running than while casually walking.

After putting on athletic shoe 100, the wearer may use inflation mechanism 360 to inflate inflatable bladder 340 until proper fit has been achieved. After this point, the wearer may tie the shoelaces to secure athletic shoe 100 to the wearer's foot. Alternatively, the wearer may tie the shoelaces first and then inflate inflatable bladder 340. If the wearer feels that inflatable bladder 340 is overinflated, the wearer may utilize release mechanism 370 to deflate inflatable bladder 340 and start over, or to adjust the fit by releasing a portion of the air in the inflatable bladder. Additionally, after the wearer is done using athletic shoe 100, the wearer may use release mechanism 370 to deflate inflatable bladder 340 until the next use.

Further variations of the embodiments described herein may also be provided. For example, while according to some embodiments, athletic shoe 100 is tongueless, as illustrated in FIGS. 1-5, other embodiments may include a tongue. Moreover, some embodiments may not use shoelaces to secure athletic shoe 100 to the wearer's foot. For example, saddle 350 on the medial and lateral sides may be connected by cords within outer layer. Other variations may also be considered suitable.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following, claims and their equivalents.

What is claimed is:

1. An article of footwear comprising:

an upper comprising an inner layer configured to receive a foot and an outer layer having a first portion more stretchable than a second portion;

a sole attached to the upper;

a strobel board disposed above the sole and attached to the inner layer, the strobel board having a medial edge and a lateral edge;

an inflatable bladder disposed between the inner layer and the outer layer, a medial edge of the inflatable bladder attached to the medial edge of the strobel board and a lateral edge of the inflatable bladder attached to the lateral edge of the strobel board, and the inflatable bladder extending across a throat region of the upper;

an inflation mechanism operatively coupled with the inflatable bladder and configured to inflate the inflatable bladder; and a saddle disposed between the inflatable bladder and the outer layer in lateral and medial quarter regions of the upper and not extending into the throat region, wherein the first portion of the outer layer covers the inflatable bladder at the throat region.

2. The article of footwear of claim 1, wherein the saddle is integral with the strobel board.

3. The article of footwear of claim 1, wherein the inner layer comprises a bootie.

4. The article of footwear of claim 1, wherein the inner layer comprises spandex.

5. The article of footwear of claim 1, wherein the inflatable bladder comprises a release agent cured to a first film by the application of ultraviolet light.

6. The article of footwear of claim 5, wherein the release agent is silicone fortified.

7. The article of footwear of claim 5, wherein the release agent is one of a paint, ink, paper, textile, particulate, photosensitive agent, polytetrafluoroethylene, silicone, plastic, and acid.

8. The article of footwear of claim 1, wherein the inflatable bladder comprises:

a first film;

a release agent applied and cured to said first film in a pattern that corresponds to the shape of an inflatable compartment of said inflatable bladder;

and a second film adhered to said first film such that said release agent is disposed between said first film and said second film, and said first film and said second film do not adhere in the vicinity of the release agent thereby forming said inflatable compartment with a peripheral edge.

9. The article of footwear of claim 1, wherein the saddle comprises a plurality of loops configured to extend through slots in the outer layer and receive a shoelace.

10. The article of footwear of claim 9, wherein the plurality of loops comprises a single continuous cord.

11. The article of footwear of claim 10, wherein the saddle further comprises a lace piece over a portion of the continuous cord.

12. The article of footwear of claim 1, wherein the outer layer comprises a screen printing on an outer surface.

13. The article of footwear of claim 1, wherein the throat region is tongueless.

14. The article of footwear of claim 1, wherein the saddle is configured to limit outward bulging of the inflatable bladder.

15. The article of footwear of claim 1, wherein the saddle is configured to limit bulging of the inflatable bladder in one of a lateral and a medial direction.

16. The article of footwear of claim 1, wherein the inflatable bladder is attached to the outer layer in the throat region.

17. The article of footwear of claim 1, wherein the inflatable bladder is attached to the outer layer and the inner layer in the throat region.

18. An upper for an athletic shoe comprising:

an inner layer configured to attach to an insole of the athletic shoe and receive a foot;

an outer layer having a first portion more stretchable than a second portion;

an inflatable bladder disposed between the inner layer and the outer layer and a lateral edge of the inflatable bladder attached to a lateral edge of a strobel board and extending from a lower lateral side of the upper across a throat region of the upper to a lower medial side of the upper and a medial edge of the inflatable bladder attached to a medial edge of the strobel board;

an inflation mechanism operatively coupled with the inflatable bladder and configured to inflate the inflatable bladder;

a lateral saddle disposed between the inflatable bladder and the outer layer in a lateral quarter region of the upper and not extending into the throat region; and a medial saddle disposed between the inflatable bladder and the outer layer in a medial quarter region of the upper and not extending into the throat region, wherein the throat region of the upper is tongueless and aligns with an edge of each of the lateral and medial saddles, and wherein the first portion of the outer layer is disposed in the throat region.

19. The upper of claim 18, wherein the inner layer comprises a bootie.

20. The upper of claim 18, wherein the inner layer comprises spandex.

21. The upper of claim 18, wherein the inflatable bladder comprises a release agent cured to a first film by the application of ultraviolet light.

22. The upper of claim 21, wherein the release agent is silicone fortified.

23. The upper of claim 21, wherein the release agent is one of a paint, ink, paper, textile, particulate, photosensitive agent, polytetrafluoroethylene, silicone, plastic, and acid.

24. The upper of claim 18, wherein the inflatable bladder comprises:

a first film;

a release agent applied and cured to said first film in a pattern that corresponds to the shape of an inflatable compartment of said inflatable bladder;

and a second film adhered to said first film such that said release agent is disposed between said first film and said second film, and said first film and said second film do not adhere in the vicinity of the release agent thereby forming said inflatable compartment with a peripheral edge.

25. The upper of claim 18, wherein each of the lateral and medial saddles comprises a plurality of loops configured to extend through slots in the outer layer and receive a shoelace.

26. The upper of claim 25, wherein each of the plurality of loops on the lateral saddle and the plurality of loops on the medial saddle comprises a single continuous cord.

27. The upper of claim 26, wherein each of the lateral and medial saddles further comprises a lace piece over a portion of the continuous cord.

28. The upper of claim 18, wherein the outer layer comprises a screen printing on an outer surface.

29. The upper of claim 18, wherein each of the lateral and medial saddles is configured to limit outward bulging of the inflatable bladder.

30. The upper of claim 18, wherein each of the lateral and medial saddles is configured to limit bulging of the inflatable bladder in one of a lateral and a medial direction.

* * * * *